United States Patent [19]

Clouser

[11] 4,295,603

[45] Oct. 20, 1981

[54] MEANS CONTROLLING A FLUE DAMPER

[75] Inventor: Michael T. Clouser, Indianapolis, Ind.

[73] Assignee: Emhart Industries, Inc., Indianapolis, Ind.

[21] Appl. No.: 93,785

[22] Filed: Nov. 13, 1979

[51] Int. Cl.[3] ..... G05D 23/00

[52] U.S. Cl. ..... 236/1 G; 236/94

[58] Field of Search ..... 236/49, 78 R, 1 G, 94; 251/130; 318/626, 345 D, 266, 466, 468

[56] References Cited

U.S. PATENT DOCUMENTS

| | | | |
|---|---|---|---|
| 3,164,755 | 1/1965 | Holt et al. | 236/94 X |
| 3,687,415 | 8/1972 | Turkot | 251/130 |
| 4,017,024 | 4/1977 | Grostick et al. | 236/1 G |
| 4,084,743 | 4/1978 | Matthews | 236/1 G |
| 4,087,045 | 5/1978 | Matthews | 236/1 G |
| 4,184,107 | 1/1980 | Turini et al. | 318/626 |

*Primary Examiner*—William E. Wayner
*Assistant Examiner*—Harry Tanner
*Attorney, Agent, or Firm*—Robert F. Meyer; David W. Gomes

[57] ABSTRACT

A flue damper is rotated 360° in a predetermined direction in 90° increments to be selectively opened and closed in 90° increments. The incremental rotation is accomplished by a motor driven timing mechanism with power to the motor being controlled by the timing mechanism and a solid state switching means selectively energizing and deenergizing the motor.

13 Claims, 2 Drawing Figures

MEANS CONTROLLING A FLUE DAMPER

BACKGROUND OF THE INVENTION

Generally speaking the present invention relates to a heating system wherein a flue damper regulates gas flow through a conduit from a heat source in accordance with a temperature demand means actuating the heat source, and more particularly to a controller connected to the flue damper that rotates it 360° in about 90° increments to selectively open and close the damper.

Numerous dampening systems for use in heat and smoke stacks have been proposed and used. Currently in some flue damper systems, for example, hysteresis type motors are used drive a coil spring loaded flue plate against a stop thereby stalling the motor with the plate in a closed position. Then, when a thermostatic switch calls for heat, a relay is pulled in and power to the motor is broken. With the motor deenergized, the coil spring causes the flue plate to open by turning the motor backwards. Then, as the flue comes to a full open position, a switch actuates a gas valve. While such an arrangement is acceptable, it does have some inherent problems. For example, a hysteresis type motor is expensive. The system requires a relatively large number of parts thus adding to fabrication costs. In addition, the use of the coil spring to return the flue to an open position causes inaccuracies with a certain amount of tendency to fail.

In another arrangement a flue damper is connected to a motor to be rotated in accordance with a programmed sequence. The motor is turned on and off through a relay. With this arrangement the use of a relay requires considerable supporting electrical circuitry which makes the system costly and in some respects relatively inaccurate.

The present invention overcomes these problems and in addition provides for other features noted hereinafter.

FEATURES OR OBJECTS OF THE INVENTION

It is, therefore, a feature of the present invention to provide a heating system having a flue damper controller. Another feature of the invention is to provide a flue damper controller which is simple and economical to produce. Another feature of the invention is to provide a flue damper controller which opens and closes the damper in 90° increments through a 360° rotation. Still another feature of the invention is to provide such a controller which actuates the heat source when the damper is fully opened. Another feature of the invention is to provide such a controller which includes a motor drive means for rotating a timing means, and electrical circuit means including solid state switching means selectively energizing and deenergizing the motor drive means. Yet still another feature of the invention is to provide such a controller wherein the flue damper is carried by a shaft of the timing and motor drive means. Another feature of the invention is to provide such a controller having a temperature demand means and a disabling circuit permitting the flue damper to completely close if the temperature demand means is set higher just as it becomes satisfied. Another feature of the invention is to provide a clutch for the shaft so that the controller can be manually set to an "on" position in the event of motor failure. These and other features of the invention will become apparent from the following description taken in conjunction with the accompanying drawings.

DETAILED DESCRIPTION OF THE INVENTION

Figure 1:
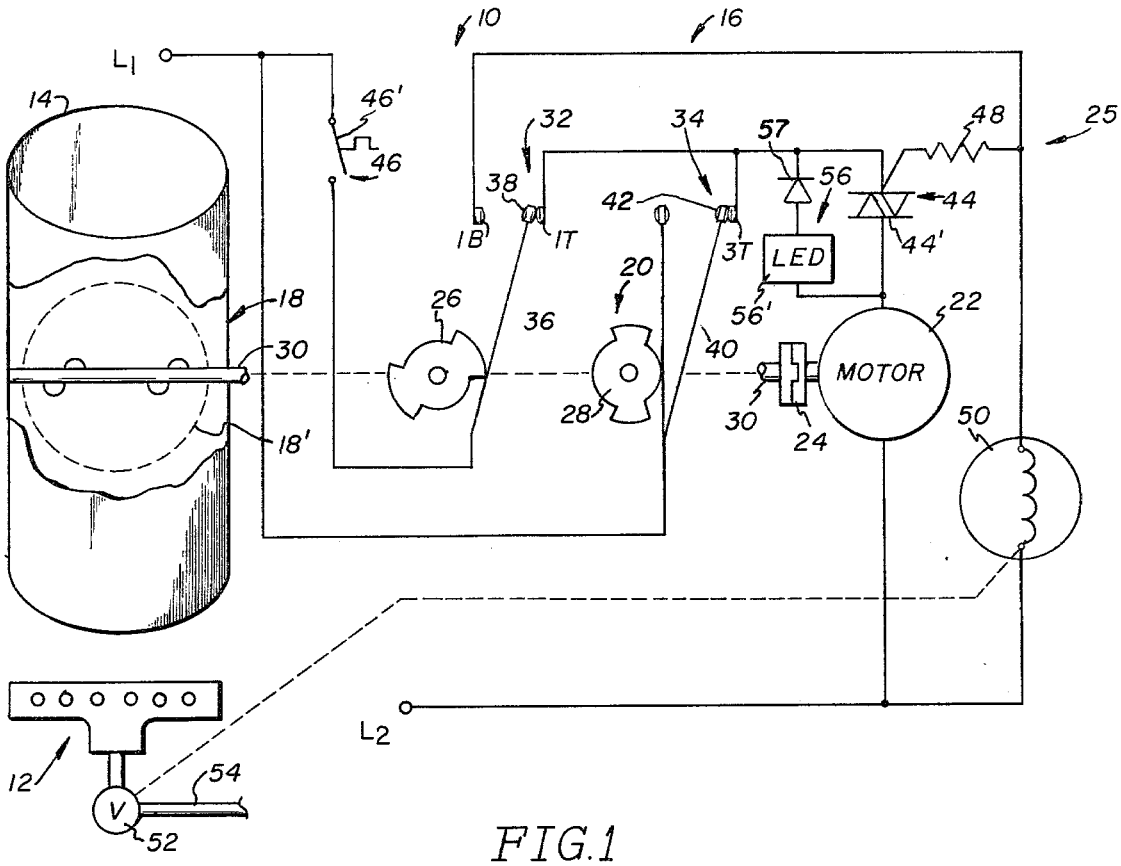
FIG. 1 is a schematic of the controller showing a flue damper in conjunction with a wiring diagram for the controller.

Referring to FIG. 1, there is shown a heating system 10 which, in general, includes a heat source 12 which supplies gas and combustion products through a conduit 14, and a controller 16 which regulates a flue damper 18 carried in conduit 14 and also regulates a supply of gas to heat source 12. The combustion products are suitably exhausted through conduit 14.

Controller 16 includes timing means 20 which is driven by a motor 22 through a suitable clutch means 24, and electrical circuitry 25 connecting the various electrical switches of the timing means 20 to the various functions of the heating system. Timing means 20 includes a pair of cams 26 and 28 carried on a shaft 30 to be rotated therewith, and electrical limit switch means 32 and 34 that are responsive to the cams. Electrical switch means 32 is of the double throw type and includes fixed electrical contacts 1B and 1T and movable contact blade 36 engaging cam 26 and having a double faced electrical contact 38 at its distal end to selectively engage electrical contacts 1B and 1T. Switch means 34 is of a single pole type having a fixed electrical contact 3T and movable contact blade 40 engaging cam 28 and having an electrical contact 42 at its distal end to selectively engage contact 3T. Shaft 30 is coupled to motor 22 through clutch means 24 to be rotated thereby and thus rotate cams 26 and 28.

Flue damper 18 includes a substantially flat circular plate 18' that is carried on shaft 30 to be rotated therewith. As will be hereinafter described, plate 18' is rotated through 360° in 90° increments to open and close conduit 14.

Electrical circuit 25 features a solid state switching means 44 which selectively energizes and deenergizes motor 22 to selectively open and close flue damper 18. Prior art flue damper control means having a motor to operate the flue damper depends on a relay to energize and deenergize the motor. Electrical circuit 25 is connected across an AC power source $L_1$ $L_2$ and includes in addition to switch means 32 and 34, a temperature demand means 46 connected to movable electrical contact 38, solid state switching means 44 that is connected between motor 22 and fixed electrical contact 3T, resistor 48 that is connected to solid state switching means 44 and fixed electrical contact 1B, and solenoid 50 which is connected between resistor 48 and $L_2$. Solenoid 50 is part of valve 52 which controls gas flow from a source (not shown) through a conduit 54 to heat source 12. Heat source 12 is of any suitable type such as a burner having a pilot valve (not shown). Temperature demand means 46 includes a thermostat 46' that is normally open prior to a heat cycle. Solid state switching means 44 includes a triac 44' that is connected MT1 to contact 3T, gate to resistor 48, and MT2 to motor 22.

As will be noted hereinafter, electrical contact 1B acts as a disabling circuit in the event thermostat 46' is set higher immediately after the thermostat has been satisfied.

Electrical circuit 25 also includes an indicator means 56 which includes a network of a light emitting diode (LED) 56' and diode 57 connected across triac 44' to indicate when a heating cycle is in progress.

Figure 2:
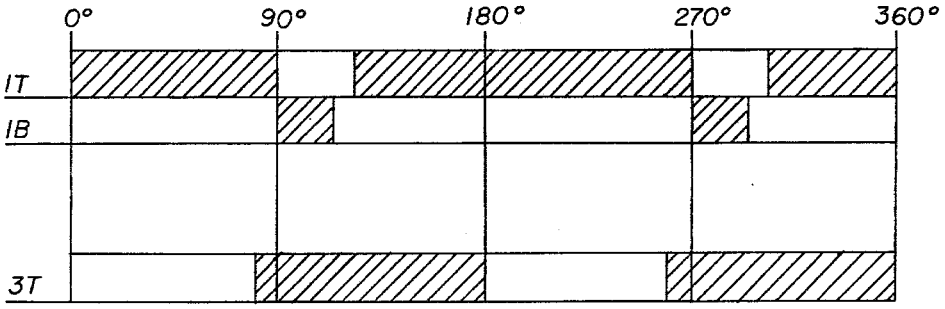
FIG. 2 is a time chart showing an operating sequence of the controller.

Referring to both FIGS. 1 and 2, the operation of the heating system can be described. At the 0° position of the time chart, contact 1T is made. When the thermostat 46' calls for heat (or closes), an electrical path is made from $L_1$ through the thermostat, through the 1T contacts, through the triac 44', and through the motor 22 to $L_2$. Since the motor is energized, it beings to run and simultaneously moves the cams 26 and 28 which control the timer contacts 1B, 1T, and 3T and the flue plate 18'. Notice that the triac is biased on by virtue of the resistor 48 and the gas valve 50 tied to L2. Contact 3T is closed just prior to full open position providing an alternate path from $L_1$ to triac 44'.

When the flue plate is at the full open position, the contact 1T switches and 1B is made. This causes the potential $L_1$ to appear at one side of the gas valve 50 and $L_2$ at the other. Thus, the gas valve is energized and a heating cycle commences. When $L_1$ appears at the gas valve, the triac 44' is biased off. Therefore, the motor is deenergized and stops. At this point, LED 56' comes on since a path for $\frac{1}{2}$ wave rectified voltage is made from $L_1$, through the 3T contact, through the LED, and through the motor to $L_2$. The motor will not run on $\frac{1}{2}$ wave and thus it also performs the function of a dropping resistor for the LED. The LED is shunted off whenever the triac is biased on; thus, the only time the LED lights up is when the heating cycle is in progress.

When the thermostat becomes satisfied and opens up, the gas valve 50 is deenergized and reverts back to its bias function for the triac 44'. Therefore, an electrical path is made from $L_1$, through the 3T contacts, through the triac, and through the motor to $L_2$. The motor thus energized again turns the cams 26 and 28 and flue plate 18' unit 3T contact breaks. At this point, if the thermostat is still open, the motor is deenergized and stops. Thus, the flue plate 18' is closed and the system is set up for the next heating cycle. If the thermostat, after being satisfied, is immediately set higher, the motor stops and the heating cycle commences as long as 1B is still made. After 1B is broken, however, the unit will complete its closing cycle before re-opening for the new call for heat. Contact 1B thus acts as a disabling circuit.

In the event of a failure of triac 44', clutch means 24 can be used to override motor 22 and the controller manually set to the "on" position so that heating capability is not lost.

What is claimed is:

1. In a heating system wherein a flue damper regulates gas flow through a conduit from a heat source in accordance with temperature demand means actuating a heat source, an improved means controlling said flue damper comprising: a control means connected to said flue damper to rotate same to selectively open and close same at about 90° increments, including alternating current motor drive means; timing means driven by said motor drive means; and electrical circuit means including switch means responsive to said timing means and controlling electrical power in said control system and solid state switching means having a gate means connected to said heat source and selectively energizing and deenergizing said motor drive means wherein said gate means de-energizes said solid state switching means when said heat source is actuated.

2. In a heating system according to claim 1 wherein said flue damper includes a plate rotatably journalled in a conduit, said plate coupled to a shaft of said motor.

3. In a heating system according to claim 2 wherein said plate is carried by said shaft.

4. In a heating system according to claim 3 wherein a clutch means is coupled to said shaft permitting manual rotation thereof when electrical power is removed from said control system.

5. In a heating system according to claim 1 wherein said temperature demand means is a thermostat.

6. In a heating system according to claim 1 wherein said electrical circuit means includes a disabling circuit permitting said flue damper to completely close if said temperature demand means is set higher just as it becomes satisified.

7. In a furnace control system according to claim 6 wherein said disabling circuit comprises a switch closing an electrical circuit to said heat source and bypassing said motor drive.

8. In a furnace control system according to claim 1 wherein said electrical circuit includes heat cycle indicating means.

9. In a furnace control system according to claim 8 wherein said heat cycle indicating means includes a light emitting diode.

10. In a heating system wherein heat is supplied from a fuel supply source through a conduit:

a flue damper plate rotatably mounted within said conduit to regulate heat flow through said conduit and a controller controlling the position of said flue damper plate comprising:

(a) a temperature demand means responsive to a request for heat, (b) a drive motor operatively associated with said flue damper plate to drive same between closed and open positions, (c) a switching means operable when energized to energize said motor, (d) a first limit switch having two electrical contacts, (e) a first energizing path through said temperature demand means and a first set of contacts of said first limit switch and through said switching means to said motor, (f) a second limit switch, (g) a second energizing path in parallel with said first energizing path bypassing said temperature demand means through said second limit switch to said switching means, (h) a third energizing path through said temperature demand means and a second set of contacts of said first limit switch to said fuel supply source, and (i) a fourth energizing path through said fuel source and said switching means, whereby current is supplied through said switching means when said fourth energizing path is active and no current is supplied to said switching means when said third energizing path is active.

11. In a heating system according to claim 10 wherein said switching means is a solid state switching means.

12. In a heating system according to claim 11 wherein said solid state switching means is a triac.

13. In a heating system wherein heat is supplied from a fuel supply source through a conduit:

a flue damper plate rotatably mounted within said conduit to regulate heat flow through said conduit and a controller controlling the position of said flue damper plate comprising:

(a) a temperature demand means responsive to a request for heat, (b) a drive motor operatively associated with said flue damper plate to drive same between closed and open positions, (c) a triac operable when energized to energize said motor, (d) a first limit switch having two electrical contacts, (e) a first energizing path through said temperature demand means and a first set of contacts of said first limit switch and through said triac to said motor, (f) a second limit switch, (g) a second energizing path in parallel with said first energizing path bypassing said temperature demand means through said second limit switch to said triac, (h) a third energizing path through said temperature demand means and a second set of contacts of said first limit switch to said fuel supply source, and (i) a fourth energizing path through said fuel source and a gate of said triac.

* * * * *